US007260349B2

(12) United States Patent
Nakade et al.

(10) Patent No.: US 7,260,349 B2
(45) Date of Patent: Aug. 21, 2007

(54) DEVELOPING ROLLER FOR USE IN IMAGE-FORMING APPARATUS AND DEVELOPING DEVICE EQUIPPED WITH THE SAME

(75) Inventors: Yohei Nakade, Okazaki (JP); Tetsuo Sano, Toyokawa (JP); Ichiro Demizu, Toyonaka (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 171 days.

(21) Appl. No.: 10/968,275

(22) Filed: Oct. 20, 2004

(65) Prior Publication Data

US 2006/0018687 A1 Jan. 26, 2006

(30) Foreign Application Priority Data

Jul. 20, 2004 (JP) ..... 2004-211516

(51) Int. Cl.
*G03G 15/08* (2006.01)

(52) U.S. Cl. ..... 399/286; 399/279

(58) Field of Classification Search ..... 399/286, 399/279, 265, 267; 430/120, 120.1; 492/18, 492/25, 53, 56, 52, 49
See application file for complete search history.

(56) References Cited

U.S. PATENT DOCUMENTS 5,099,285 A * 3/1992 Hirano et al. ..... 399/286
6,319,181 B1 11/2001 Naoi et al.
6,681,093 B2 1/2004 Inoue et al.
2003/0016967 A1* 1/2003 Ozeki et al. ..... 399/286
2003/0175055 A1* 9/2003 Machida et al. ..... 399/286 X
2004/0240910 A1* 12/2004 Koyanagi et al. ..... 399/286

FOREIGN PATENT DOCUMENTS

JP 2002-14536 A 1/2002
JP 2004-037665 2/2004

OTHER PUBLICATIONS

Official Action (Notification of Reasons of Refusal) issued by the Japanese Patent Office in Priority JP Application No. 2004-211516 on Oct. 31, 2006, and English translation thereof.
Notification of Reasons of Refusal issued in corresponding Japanese Patent Application No. 2004-211516. Issue No. 163639.
English translation of the Notification of Reasons for Refusal issued in corresponding Japanese Patent Application No. 2004-211516, which was originally submitted in an Information Disclosure Statement filed on May 9, 2007.
Partial translation of JP 2004-037665 (previously submitted).

* cited by examiner

*Primary Examiner*—Sophia S. Chen
(74) *Attorney, Agent, or Firm*—Buchanan Ingersoll & Rooney PC

(57) ABSTRACT

A developing roller for use in an image-forming apparatus includes a substrate, a silicone-based elastic layer formed on the substrate, and a surface-coating layer formed at the outermost surface. The surface-coating layer has a thickness of not less than 3.5 μm with an amount of detection of silicon-atom-containing substances on the surface of the developing roller being set to not more than 2.5, and a developing device equipped with the developing roller.

10 Claims, 3 Drawing Sheets

DEVELOPING ROLLER FOR USE IN IMAGE-FORMING APPARATUS AND DEVELOPING DEVICE EQUIPPED WITH THE SAME

This application is based on application No. 2004-211516 filed in Japan, the contents of which are hereby incorporated by reference.

BACKGROUND OF THE INVENTION

1. Field of the Invention

The present invention relates to a developing roller that is incorporated into a developing device for use in an image-forming apparatus so as to transport and supply toner to an opposing area to a photosensitive member (a developing area), and more particularly, concerns a mono-component-developing-use developing roller.

2. Description of the Related Art

The mono-component-developing-use elastic developing roller, which is a developing roller to be incorporated into a developing device of a mono-component developing system, charges toner in a gap between it and a toner-regulating blade, and transports and supplies the charged toner to a developing area while supporting the charged toner.

Conventionally, with respect to the mono-component-developing-use elastic developing roller, those having a silicone-based elastic layer and a surface-coating layer formed on a substrate have been well known, from the viewpoint of charge-applying capability to toner and durability.

However, when the above-mentioned developing roller is used for a long time, problems are raised in that the toner charging property is lowered, in that the toner transport quantity to a developing area between the developing roller and the photosensitive member fluctuates and in that toner is fixed on the toner regulating blade. The toner fixing to the blade is conspicuous in the low-temperature, low-humidity environment. The degradation in the charging stability is conspicuous in the standard environment as well as in the high-temperature, high-humidity environment.

SUMMARY OF THE INVENTION

The present invention is to provide a developing roller that prevents degradation in the toner-charging property, fluctuations in the toner transport quantity and toner fixing to the regulating blade, even when it is used for a long time under any environment.

The present invention relates to a developing roller for use in an image-forming apparatus, comprising:

a substrate;

a silicone-based elastic layer formed on the substrate; and surface-coating layer formed at the outermost surface; wherein the surface-coating layer has a thickness of not less than 3.5 μm with an amount of detection of silicon-atom-containing substances on the surface of the developing roller being not more than 2.5, and a developing device equipped with the developing roller.

DETAILED DESCRIPTION OF THE INVENTION

The present invention provides a developing roller for use in an image-forming apparatus, comprising:

a substrate;

a silicone-based elastic layer formed on the substrate; and surface-coating layer formed at the outermost surface; wherein the surface-coating layer has a thickness of not less than 3.5 μm with an amount of detection of silicon-atom-containing substances on the surface of the developing roller being not more than 2.5, and a developing device equipped with the developing roller.

The inventors of the present invention have noted that unreacted substances (low-molecular-weight silicon-atom-containing substances, for example, monosilane components and siloxane components, such as dimers to hexamers of silane) in a silicone-based elastic layer or the like of the developing roller ooze onto the developing roller surface, and found that the above-mentioned objectives can be achieved by reducing the ooze quantity.

Since the developing roller of the present invention effectively reduces unreacted substances located on the surface of the developing roller, it becomes possible to prevent the substances from giving adverse effects to the toner. Thus, the developing roller makes it possible to stabilize the toner-charging property, to reduce fluctuations in the toner transport quantity and also to effectively prevent toner fixing to the toner-regulating blade, even when it is used for a long time under any environment.

DETAILED DESCRIPTION OF THE INVENTION

Figure 1:
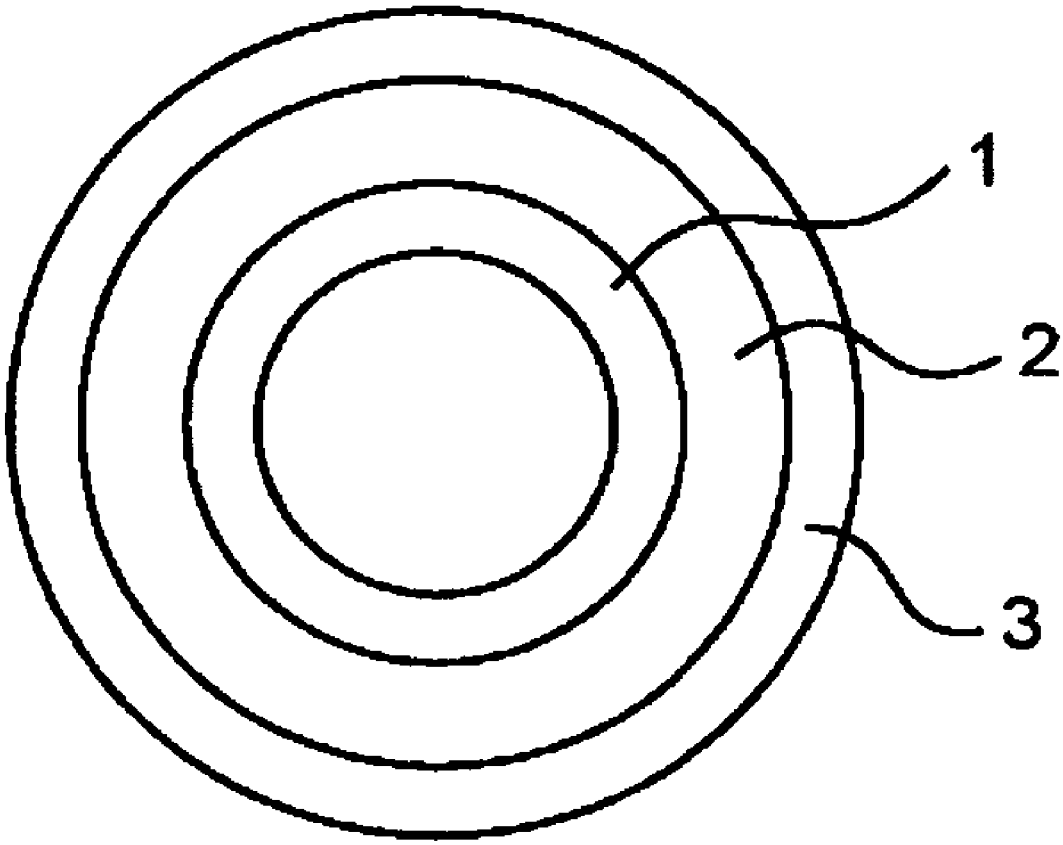
FIG. 1 is a schematic cross-sectional view perpendicular to the axis direction of a developing roller of the present invention.

For example, as shown in FIG. 1, the developing roller of the present invention is provided with at least silicone-based elastic layer 2 and a surface-coating layer 3 formed on a substrate 1, and features that the minimum thickness of the surface-coating layer 3 is not less than 3.5 μm.

The surface-coating layer of the developing roller forms the outermost surface of the developing roller, and it is generally difficult to set its thickness to a uniform value due to irregularities on the surface of a layer located beneath the coating layer (for example, elastic layer), and there are portions in which the coating layer is thinner depending on places. For example, when, as in the case of a conventional developing roller, a surface-coating layer having an average thickness in a range of approximately 10 to 30 μm is formed under conditions of: coating method: spray coating method; the number of coating processes: once; drying conditions: air-drying, the minimum thickness is normally set in a range of approximately 0 to 1 μm. It can be thought that when the coating layer have such thinner portions, materials and side-products derived from the silicone-based elastic layer and the like (in particular, low-molecular-weight silicon-atom-containing substances, for example, monosilane components and siloxane components, such as dimers to hexamers of silane) ooze from the corresponding portions and are adsorbed to the toner, thereby resulting in degradation in the toner charging property, fluctuations in the toner transport quantity to a developing area between the developing roller and the photosensitive member and fixation of the toner onto the toner regulating blade. In the present invention, since the minimum thickness of the surface-coating layer that forms the developing roller outermost surface is set in the above-mentioned range, it becomes possible to effectively reduce the silicon-atom-containing substances derived from the silicone-based elastic layer and the like that ooze onto the developing roller surface. Therefore, the present invention makes it possible to stabilize the toner-charging property and also to effectively prevent fluctuations in the toner transport quantity and toner fixation to the toner-regulating blade, even when the developing roller is used for a long time under any environment.

When the minimum thickness of the surface-coating layer is too small, it is not possible to effectively prevent the ooze of silicon-atom-containing substances, resulting in problems such as degradation in the toner-charging property, fluctuations in the toner transport quantity and/or toner fixation to the toner-regulating blade.

The amount of detection of the silicon-atom-containing substances on the developing roller surface of the present invention is preferably not more than 2.5, preferably in a range from 1.5 to 2.5. The amount of detection exceeding 2.5 tends to cause problems, such as degradation in the toner-charging property, fluctuations in the toner transport quantity and/or toner fixation to the regulating blade.

Although not particularly limited as long as the above-mentioned minimum thickness is achieved, the average thickness of the surface-coating layer is preferably set in a range from 5 to 30 μm. As the average thickness becomes greater, the above-mentioned minimum thickness can be achieved more easily, and the present invention makes it possible to effectively reduce the amount of ooze of silicon-atom-containing substances by setting the thickness of the surface-coating layer to a uniform value while maintaining the average thickness within the above-mentioned range.

In the present specification, with respect to the minimum thickness and average thickness of the surface-coating layer, values obtained through the following measuring method are used. However, the measuring method is not intended to be limited to the following method, and any measuring method may be used as long as the method allows measurements based upon the same principle and rule as the following method. A roller cross-section is sliced, and the cross-sectional shape is photographed through a microscope so as to carry out measurements.

Figure 2A:
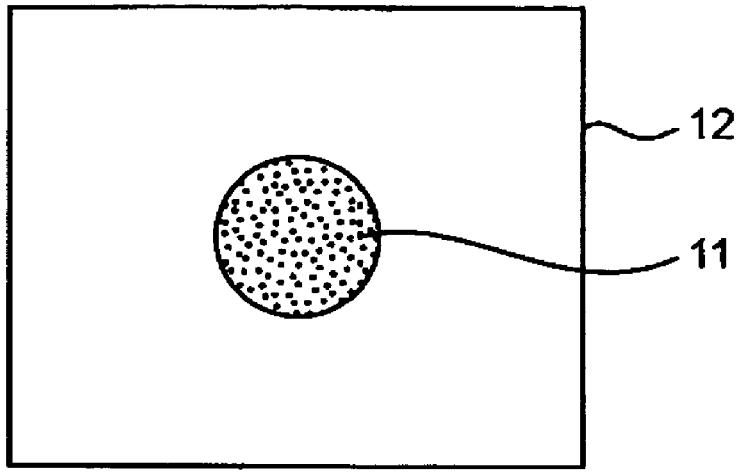
FIGS. 2A and 2B are schematic illustrations that explain a measuring method for Si-component detection amount.
Figure 2B:
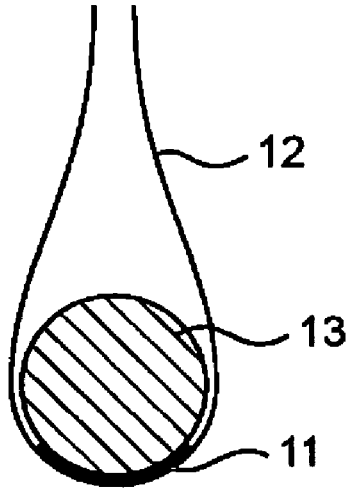

The amount of detection of silicon-atom-containing substances (Si components) on a developing roller surface corresponds to the amount of ooze of Si components obtained from severe environmental tests at a temperature of 55° C. and a humidity in a range from 40 to 70%. Since, upon measuring the amount of ooze of Si components, it is difficult to actually carry out an elemental analysis on the developing roller surface, an adsorption film is allowed to adsorb the oozed Si components, and the resulting film is subjected to analyses. More specifically, as shown in FIG. 2A, an adsorption film 11 (ADVANTEC MEMBRANE FILTERS MIXED CELLULOSE ESTER; made by ADVANTEC CO., LTD.) was affixed onto a PET film 12. As shown in FIG. 2B, a developing roller 13 was placed thereon, and made to adhere to the adsorption film 11 by the dead weight of developing roller (about 280 g). The resulting roller in this state was stored under the above-mentioned severe environmental conditions for 1264 hours. After the storage, the adsorption film 11 was taken out and the Si component of the adsorption film was analyzed. An analyzer S-792X1 made by Horiba Seisakusho Co., Ltd. was used (analyzer measuring conditions: magnification: 100 times; vapor deposition time: 150 seconds). With respect to the amount of leak, the detection intensity at the time of DT25% (EDX) was measured.

The developing roller of the present invention was manufactured by successively forming a silicone elastic layer and a surface-coating layer on a substrate and heating the resulting roller.

With respect to the substrate 1, not particularly limited as long as it is a conductor member capable of supporting the layers formed thereon, for example, a cylinder-shaped core member made of metal such as iron, aluminum and stainless is used. This may be subjected to a plating process.

The silicone-based elastic layer 2 comprises so-called silicone rubber made by curing organopolysiloxane, and preferably has a volume resistivity in a range from 103 to 106 Ω·cm and JIS-A hardness in a range from 30° to 60°. It can be thought that organopolysiloxane contains low-molecular-weight silicon-atom containing substances, such as monosilane components and siloxane components such as dimers to hexamers of silane, and since one portion of these remains without being consumed even during a curing process, these low-molecular-weight silicon-atom containing substances are allowed to ooze onto the surface of the surface-coating layer.

With respect to organopolysiloxane to be used for forming the silicone-based elastic layer, materials, for example, represented by the following general formula (I) may be used.

(I)

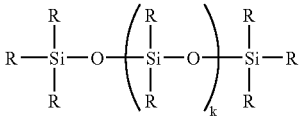

In formula (I), R each independently represents a hydrogen atom, an alkyl group, an aryl group, a vinyl group or an allyl group. With respect to the alkyl group, those having 1 to 4 carbon atoms, in particular, having one carbon atom, are preferably used; and examples thereof include a methyl group, an ethyl group, a n-propyl group and an isopropyl group. With respect to the aryl group, those having 6 to 10 carbon atoms, in particular, having 6 carbon atoms, are preferably used; and examples thereof include a phenyl group and a naphthyl group.

With respect to k, not particularly limited as long as the objective of the present invention is achieved, it is normally in a range from 4 to 10, in particular, from 6 to 8.

Organopolysiloxane as described above is available as a commercial product, for example, made by Dow Corning Toray Silicone Co., LTD.

Specific examples for the curing agent for curing organopolysiloxane include polyorganohydrogen siloxane.

With respect to the degree of curing of the organopolysiloxane cured material constituting the silicone-based elastic layer, not particularly limited as long as the objective of the present invention is achieved, it is preferably set in a range so as to allow the elastic layer to have the above-mentioned hardness.

In order to achieve the above-mentioned volume resistivity, the silicone-based elastic layer generally contains a conductivity-applying agent. With respect to the conductivity-applying agent to be contained in the elastic layer of the present invention, materials selected from the group of the same materials as those exemplified as the conductivity-applying agent to be contained in the surface-coating layer, which will be described later, may be used. A preferable example of the elastic-layer-use conductivity-applying agent is carbon black.

The silicone-based elastic layer may be formed on the conductive core member serving as the substrate by using any one of molding methods, such as extrusion-molding, injection-molding and casting methods. After the molding process, the layer is cured so that elasticity is applied thereto. After forming the elastic layer, the surface is preferably polished by using various polishing processes in order to improve the dimensional precision (outer diameter, deflection) and the uniformity of the surface (surface roughness).

Although not particularly limited, the average thickness of the silicone-based elastic layer is, for example, set in a range from 0.3 to 3.0 mm, preferably from 0.5 to 2.0 mm.

With respect to the surface-coating layer 3, any material may be used as long as the above-mentioned minimum thickness is achieved with the above-mentioned average thickness being prepared, if desired, and the material contains no silicon-atom-containing substance. Specific examples of such materials for the surface-coating layer include: various thermoplastic elastomers such as polystyrene-based, polyolefin-based, polyurethane-based, polyester-based, polyvinyl chloride-based, polybutadiene-based and polyamide-based elastomers, and various cured rubbers such as natural rubber, cis-polyisoprene rubber, styrene-butadiene rubber, cis-polybutadiene rubber, chloroprene rubber, butyl rubber, nitrile rubber, ethylene-propylene rubber, acrylic rubber and urethane rubber. Among these, urethane rubber is more preferably used.

The surface-coating layer generally has a volume resistivity in a range from 107 to 1010 Ω·cm and JIS-A hardness in a range from 50° to 80°.

In order to achieve the above-mentioned volume resistivity, the surface-coating layer generally contains a conductivity-applying agent.

The conductivity-applying agent comprises carbon black, metal powder and the like. A preferable conductivity-applying agent is carbon black.

With respect to the surface-coating layer, the surface roughness may be controlled by applying a volatile solvent (holes resulting from the volatile process are utilized) or roughness-applying particles such as resin particles and inorganic fine particles thereto.

With respect to the volatile solvent, those solvents that are completely volatilized before a polyurethane reaction in the surface-coating layer has been completed. Examples thereof include low-boiling-point organic solvents that do not react with the coating material or hardly react therewith. Examples thereof include dimethyl silicone oil and cyclic silicone oil.

Examples of the resin particles include acrylic resin particles and silicone resin particles. Examples of the inorganic particles include silica fine particles and metal oxide particles such as titania particles.

The surface-coating layer is formed through processes in which a coating solution, prepared by mixing and dispersing a coating-layer constituent material, various additives such as a roughness-adjusting agent and a solvent or the like, is applied and dried.

In the case when the surface-coating layer contains urethane rubber, the material is constituted by a polyol component and an isocyanate component, and in particular, a fluorine-containing polyol is preferably used as the polyol component. For example, polyols, such as a copolymer polyol mainly composed of a trifluoride ethylene monomer and a copolymer polyol mainly composed of tetrafluoride ethylene monomer, may be used. With respect to the isocyanate component, diisocyanates, such as diphenyl methane diisocyanates (MD) and tolylene diisocyanates (TDI), urethane-modified diisocyanates and alcohol-modified diisocyanates, may be preferably used.

Examples of fluorine-containing polyols include: Zeffle (made by Daikin Industries, Ltd.), Lumiflon (made by Asahi Glass Co., Ltd.) and Defensa (made by Dainippon Ink & Chemicals, Inc.). Examples of urethane-modified diisocyanates include: Duranate (made by Asahi Kasei Corporation), and examples of alcohol-modified diisocyanates include: Cosmonate (made by Mitsui Takeda Chemicals Inc.).

With respect to the solvent, not particularly limited as long as it can dissolve the above-mentioned materials and does not intervene with the formation of the surface-coating layer material, examples thereof include butyl acetate, ethyl acetate, xylene and toluene.

The minimum thickness of the surface-coating layer, defined by the present invention, can be controlled by properly adjusting and modifying conditions, such as the number of applications and amount of coat of the surface coating solution.

For example, the greater the amount of coat of the surface coating solution, the greater the minimum thickness becomes. In contrast, the smaller the amount of coat of the surface coating solution, the smaller the minimum thickness becomes.

The greater the number of applications of the surface coating solution, the greater the minimum thickness becomes. In contrast, the smaller the number of applications of the surface coating solution, the smaller the minimum thickness becomes.

With respect to the coating method, any one of generally-used methods, such as a spray coating method, a roll coater method and a brush coating method, may be used. In particular, the spray coating method is preferably used because the adjustment of the amount of coat is easily carried out by adjusting factors, such as the discharging pressure, the needle, the shifting speed with respect to the coating surface and the distance to the coating face.

With respect to the drying method, methods, such as an air-drying method in which the layer is naturally dried, a drying method in which air is forcefully applied to the layer and a heat drying method, may be used.

With respect to the developing roller of the present invention, an adhesive layer (not shown) may be formed between the substrate 1 and the silicone-based elastic layer 2, and/or a primer layer (not shown) may be formed between the silicone-based elastic layer 2 and the surface-coating layer 3, if necessary.

The adhesive layer, which is formed so as to prevent separation between the substrate and the elastic layer, contains, for example, a thermoplastic resin (low-molecular-weight polyolefin or the like), any one of various coupling agents or the like.

With respect to the coating method for the adhesive layer, depending on materials, the corresponding material is heated or dissolved in a solvent so that the resulting solution is coated. For example, methods, such as a spray coating method, a roll coater method, and a brush coating method, may be used.

Not particularly limited, the average thickness of the adhesive layer is preferably set, for example, in a range from 0.1 to 10 μm.

The average thickness of the adhesive layer can be measured by using the same method as the surface-coating layer.

The primer layer, which is formed so as to prevent separation of the surface-coating layer 3, contains, for example, a silane coupling agent. Even in the case when the silane coupling agent is used as the primer layer material, the objectives of the present invention are effectively achieved.

The silane coupling agent, which is an organic silicon compound having a functional group capable of reacting with an elastic layer constituent material and a functional group capable of reacting with a surface-coating layer constituent material, includes, for example, an isocyanate-based, amino-based, mercapto-based, vinyl-based, epoxy-based, styryl-based, methacryloxy-based, acryloxy-based, ureido-based, chloropropyl-based and sulfide-based silane-coupling agent for use.

The silane coupling agent is selected depending on the surface-coating layer constituent material. For example, when the surface-coating layer causes a urethane reaction, an isocyanate-based silane coupling agent, an epoxy-based silane coupling agent and an amino-based silane coupling agent may be used. When the surface-coating layer causes an addition reaction of a vinyl group, a vinyl-based silane coupling agent may be used.

Examples of the isocyanate-based silane coupling agent include commercial products, such as KBP-44 and KBE-9007 (made by Shin-Etsu Chemical Co., Ltd.).

Examples of the amino-based silane coupling agent include commercial products, such as KBP-40, KBP-41, KBP-43, KBP-90, KBM-602, KBM-603, KBE-603, KBM-903, KBE-903, KBE-9103, KBM-573, KBM-575 and KBM-6123 (made by Shin-Etsu Chemical Co., Ltd.).

Examples of the mercapto-based silane coupling agent include commercial products, such as X-12-414, KBM-802 and KBM-803 (made by Shin-Etsu Chemical Co., Ltd.).

Examples of the vinyl-based silane coupling agent include commercial products, such as KA-1003, KBM-1003 and KBE-1003 (made by Shin-Etsu Chemical Co., Ltd.).

Examples of the epoxy-based silane coupling agent include commercial products, such as KBM-303, KBM-403, KBE-402 and KBE-403 (made by Shin-Etsu Chemical Co., Ltd.).

Examples of the styryl-based silane coupling agent include commercial products, such as KBM-1403 (made by Shin-Etsu Chemical Co., Ltd.).

Examples of the methacryloxy-based silane coupling agent include commercial products, such as KBM-502, KBM-503, KBE-502 and KBE-503 (made by Shin-Etsu Chemical Co., Ltd.).

Examples of the acryloxy-based silane coupling agent include commercial products, such as KBM-5103 (made by Shin-Etsu Chemical Co., Ltd.).

Examples of the ureido-based silane coupling agent include commercial products, such as KBE-585 (made by Shin-Etsu Chemical Co., Ltd.).

Examples of the chloropropyl-based silane coupling agent include commercial products, such as KBM-703 (made by Shin-Etsu Chemical Co., Ltd.).

Examples of the sulfide-based silane coupling agent include commercial products, such as KBE-846 (made by Shin-Etsu Chemical Co., Ltd.).

The primer layer may contain a conductivity-applying agent. With respect to a conductivity-applying agent to be contained in the primer layer in the present invention, selection is made from the same group of materials as exemplified as the conductivity-applying agent to be contained in the surface-coating layer.

The primer layer is formed through processes in which a primer solution, prepared by dissolving or dispersing a silane coupling agent and desired additives in a solvent, is applied and then dried. Not particularly limited as long as it dissolves the silane coupling agent, examples of the solvent include ethanol, toluene, ethyl acetate, xylene and water.

The application amount of the primer solution, which is preferably adjusted so that the average thickness of the primer layer is set in a range from 0.1 to 5 μm, preferably from 1 to 3 μm, is normally set in a range from 0.02 to 1.0 $mg/cm^2$, preferably from 0.2 to 0.6 $mg/cm^2$.

The average thickness of the primer layer can be measured by cutting the roller and enlarging the cross section by using a microscope or the like.

After having formed the respective layers on the substrate, the heating conditions are normally set at a temperature range of 120° to 180° C. for 30 minutes to 2 hours in its heating time. Such a heating process allows the reactions in the respective layers to complete.

Figure 3:
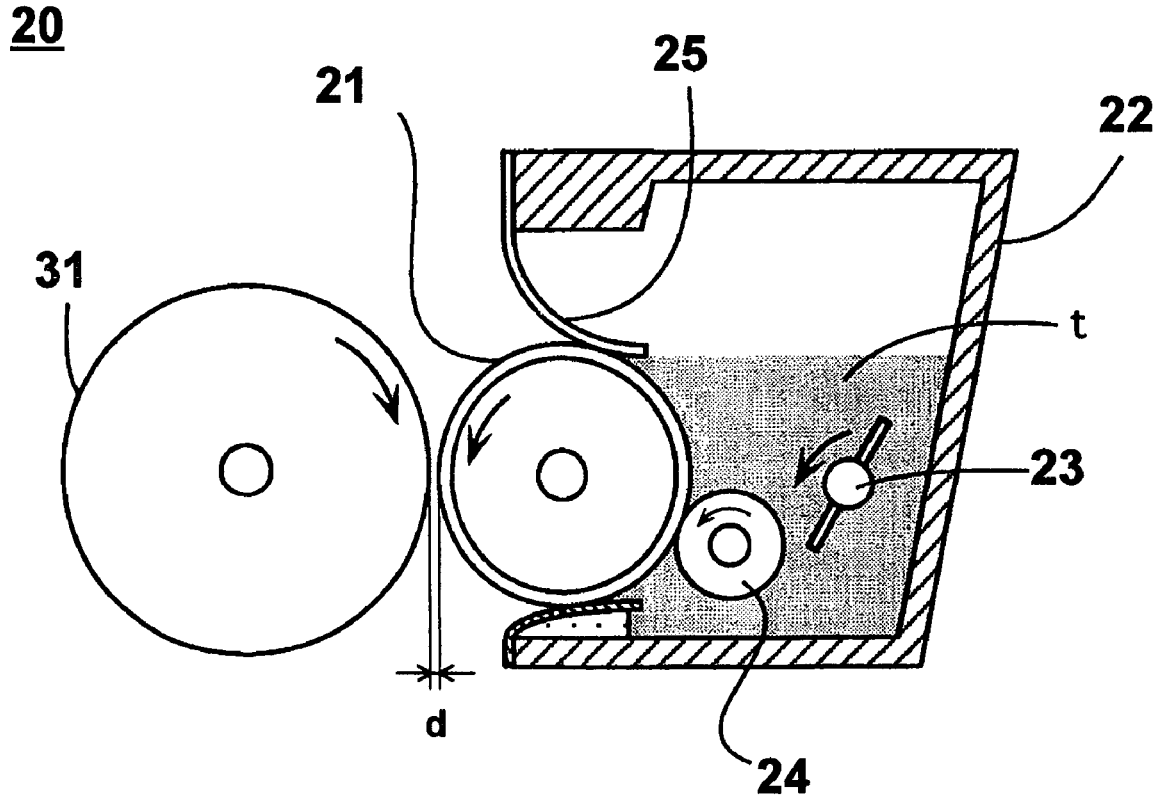
FIG. 3 is a schematic block diagram of a developing device equipped with a developing roller of the present invention.

The developing roller of the present invention is effectively applied to a developing device of a mono-component developing system. An example of the mono-component developing device is shown in FIG. 3. In the developing device 20 shown in FIG. 3, the developing roller 21 is located oppositely to an image-supporting member 31 with a specified space d between the two in a developing area. While the developing roller 21 and the image-supporting member 31 are rotated, toner t housed in a casing 22 is fed to a supply roller 24 rotating in contact with the developing roller 21 by a feeding member 23. The toner t is supplied to the surface of developing roller 21 from the supply roller 24.

A regulating member 25 in contact with the surface of developing roller 21 regulates an amount of toner t supplied on the surface of developing roller 21 and charges the toner t electrically. The toner t is transported to a developing area opposite to the image-supporting member 31. A voltage is applied between the developing roller 21 and the image-supporting member 31, so that toner t is supplied to electrostatic latent images formed on the image-supporting member for development.

EXAMPLES

<Production of Developing Roller A>

(Preparation of Primer Solution)

Silane coupling agent (KBP-44; made by Shin-Etsu Chemical Co., Ltd.)(100 parts by weight) was diluted in 300 parts by weight of isopropyl alcohol to prepare a primer solution.

(Preparation of Surface-Coating Solution)

To 100 parts by weight of fluorine-containing polyol (Zeffle, made by Daikin Industries, Ltd. and 8 parts by weight of conductive carbon black (made by Cabot Corporation) was added 300 parts by weight of butyl acetate, and dispersed by using a disperser; thus, a main agent for a coating solution was prepared. To this main agent was added urethane-modified hexamethylene diisocyanate (Duranate, made by Asahi Kasei Corporation) serving as a curing agent so that equivalent of the hydroxyl group in the main agent and equivalent of the isocyanate group in the curing agent may become a ratio of 1:1; thus, a surface-coating solution was prepared.

(Production of Developing Roller)

A core metal shaft, which was made of iron and had an outer diameter of 16 mm, was coated with conductive silicone rubber having a volume resistivity of $10^3$ Ω·cm and JIS-A hardness of 45°, and polished to form a silicone rubber-coated roller having an outer diameter of 18 mm.

The above-mentioned rubber-coated roller was spray-coated with the primer solution so as to be set at 0.5 mg/cm$^2$, and air-dried. Thereafter, this was then spray-coated with the surface-coating solution (amount of coat; 2.6 mg/cm$^2$), and after having been air-dried, this was heated at 180° C. for 60 minutes to prepare a developing roller.

<Production of Developing Rollers B to J>

The same method as the manufacturing method for developing roller A was used, except that the conditions used for forming the surface-coating layer were changed as listed in Table 1, to form each of developing rollers. In the case when the number of coating processes was not less than two times, the spray coating conditions were adjusted so that the amount of coat per one time was set to each of values shown in Table 1.

TABLE 1

| Developing roller | Surface roughness Ra of elastic layer | Number of coating processes (Target average coating layer thickness 14μ) | Amount of coat per one coating process (mg/cm$^2$) | Minimum thickness of surface-coating layer (μm) | Detection intensity | JIS-A Hardness |
|---|---|---|---|---|---|---|
| A | 2.6 | 1 | 2.6 | 2 | 3.5 | 45° |
| B | 2.6 | 2 | 1.3 | 2.5 | 3 | 45° |
| C | 2.6 | 4 | 0.65 | 3 | 2.8 | 45° |
| D | 2.6 | 6 | 0.43 | 3.5 | 2.5 | 45° |
| E | 2.6 | 8 | 0.33 | 4 | 2.2 | 45° |
| F | 2.4 | 1 | 2.6 | 2.5 | 3.3 | 45° |
| G | 2.4 | 2 | 1.3 | 3 | 2.9 | 45° |
| H | 2.4 | 4 | 0.65 | 3.5 | 2.5 | 45° |
| I | 2.4 | 6 | 0.43 | 4 | 2.4 | 45° |
| J | 2.4 | 8 | 0.33 | 7 | 2 | 45° |

The minimum thickness of the surface-coating layer and the amount of Si-component detection on the surface of the surface-coating layer were respectively measured in accordance with the aforementioned methods.

<Evaluation>

Each of the developing rollers was incorporated into a developing device of a magicolor 7300 made by Konica Minolta Business Technologies, Inc., and endurance printing test of 10,000 sheets were carried out by using a print pattern chart of 5% for each of the colors so that the quantity of charge of toner and the amount of toner transport on the developing roller as well as the toner-regulating blade in the initial stage and after the endurance tests were evaluated. With respect to the evaluation environments, evaluations were respectively carried out under the standard environment (temperature 23±3° C., humidity 65±5%), high temperature-high humidity environment (temperature 35±3° C., humidity 85±5%) and low temperature-low humidity environment (temperature 10±2° C., humidity 15±5%).

(Evaluations of Toner Charging Stability of Developing Roller and Transport Stability)

The amount of toner transport M/A (g/m$^2$) was obtained by suction-collecting toner supported on the developing roller in the middle of a solid-white image developing process, and based upon the toner weight M at that time and a charge Q that has been raised by sucking toner from the developing roller, the quantity of charge Q/M (μC/g) per unit weight on the developing roller was calculated.

Toner Charging Stability

Evaluation was made based upon the absolute value of a difference between a quantity of charge in the initial stage (after printing 500 sheets) and a quantity of charge after endurance printing process (after printing 10,000 sheets) measured through the above-mentioned method.

○: less than 8 μC/g;

Δ: from not less than 8 μC/g to less than 10 μC/g;

x: not less than 10 μC/g.

Toner Transporting Property

Evaluation was made on each of the amounts of transported toner in the initial stage and after endurance printing process according to the following standard, and the results of the worse case were shown.

○: from not less 5 g/m$^2$ to less than 8 g/m$^2$;

Δ: from not less 4 g/m$^2$ to less than 5 g/m$^2$, or from not less than 8 g/m$^2$ to less than 10 g/m$^2$;

x: less than 4 g/m$^2$, or not less than 10 g/m$^2$.

(Toner Fixing to Toner-regulating Blade)

Evaluation was made on toner fixing to the toner-regulating blade after endurance printing tests.

○: No toner fixing to the blade;

Δ: Slight toner fixing to the blade; however, no problem is raised in practical use;

x: Toner fixing to the blade, causing noise in an image.

(Over-all Evaluation)

○: ○in all the results of evaluation;

Δ: There was no x in any of the results of evaluation, with at least one Δ included;

x: There was at least one x in any of the results of evaluation.

The results are shown in the following Table.

TABLE 2

| | Low temperature-low humidity | | | Standard condition | | | High temperature-high humidity | | | |
|---|---|---|---|---|---|---|---|---|---|---|
| Developing roller | Charging stability | Transporting property | Toner fixing to blade | Charging stability | Transporting property | Toner fixing to blade | Charging stability | Transporting property | Toner fixing to blade | Over-all evaluation |
| A | x | x | x | x | x | x | x | x | x | x |
| B | x | Δ | Δ | x | Δ | Δ | x | Δ | Δ | x |
| C | ○ | Δ | Δ | x | Δ | Δ | x | Δ | Δ | x |
| D | ○ | ○ | Δ | Δ | ○ | ○ | Δ | ○ | ○ | Δ |
| E | ○ | ○ | ○ | ○ | ○ | ○ | ○ | ○ | ○ | ○ |
| F | x | x | x | x | x | x | x | x | x | x |
| G | ○ | Δ | Δ | Δ | Δ | Δ | x | Δ | Δ | x |
| H | ○ | ○ | Δ | Δ | ○ | ○ | Δ | ○ | ○ | Δ |
| I | ○ | ○ | ○ | ○ | ○ | ○ | ○ | ○ | ○ | ○ |
| J | ○ | ○ | ○ | ○ | ○ | ○ | ○ | ○ | ○ | ○ |

What is claimed is:

1. A developing roller for use in an image-forming apparatus, comprising:

a substrate;

a silicone-based elastic layer formed on the substrate; and surface-coating layer formed at the outermost surface; wherein the surface-coating layer has a thickness of not less than 3.5 μm with an amount of detection of silicon-atom-containing substances on the surface of the developing roller being not more than 2.5.

2. The developing roller according to claim 1, wherein the amount of detection of silicon-atom-containing substances on the developing roller surface is in a range from 1.5 to 2.5.

3. The developing roller according to claim 1, wherein an average thickness of the surface-coating layer is in a range from 5 to 30 μm.

4. The developing roller according to claim 1, wherein the silicone-based elastic layer is formed of silicone rubber and has a volume resistivity in a range from $10^3$ to $10^6$ Ω·cm and JIS-A hardness in a range from 30° to 60°.

5. The developing roller according to claim 1, being mono-component-developing-use developing roller.

6. A developing device, comprising:

a casing;

a toner housed in the casing; and a developing roller which supports toner on the surface and transports the toner;

wherein the developing roller comprises:

a substrate;

a silicone-based elastic layer formed on the substrate; and surface-coating layer formed at the outermost surface; the surface-coating layer having a thickness of not less than 3.5 μm with an amount of detection of silicon-atom-containing substances on the surface of the developing roller being not more than 2.5.

7. The developing device according to claim 6, wherein the amount of detection of silicon-atom-containing substances on the developing roller surface is in a range from 1.5 to 2.5.

8. The developing device according to claim 6, wherein an average thickness of the surface-coating layer is in a range from 5 to 30 μm.

9. The developing device according to claim 6, wherein the silicone-based elastic layer is formed of silicone rubber and has a volume resistivity in a range from $10^3$ to $10^6$ Ω·cm and JIS-A hardness in a range from 30° to 60°.

10. The developing device according to claim 6, being mono-component-developing device with a regulating member equipped in pressure contact with the developing roller.

* * * * *